US011913180B1

(12) United States Patent
Fernandez Lillo et al.

(10) Patent No.: US 11,913,180 B1
(45) Date of Patent: Feb. 27, 2024

(54) BRIDGE CONSTRUCTION METHOD AND BRIDGE

(71) Applicant: TX Bridge Robotics, INC., Miami, FL (US)

(72) Inventors: Carlos Fernandez Lillo, Miami, FL (US); Gabriel Maria Jimenez Lopez Alegria, Miami, FL (US)

(73) Assignee: TX Bridge Robotics, INC., Miami, FL (US)

( * ) Notice: Subject to any disclaimer, the term of this patent is extended or adjusted under 35 U.S.C. 154(b) by 0 days.

(21) Appl. No.: 18/314,921

(22) Filed: May 10, 2023

(51) Int. Cl.
*E01D 19/00* (2006.01)
*E01D 19/02* (2006.01)
*E01D 21/00* (2006.01)
*E01D 101/26* (2006.01)

(52) U.S. Cl.
CPC ..... *E01D 19/02* (2013.01); *E01D 21/00* (2013.01); *E01D 2101/268* (2013.01)

(58) Field of Classification Search
CPC .... E01D 19/00; E01D 21/00; E01D 2101/268
USPC ..... 404/14, 73–78; 14/14, 73–78
See application file for complete search history.

(56) References Cited

U.S. PATENT DOCUMENTS 4,709,435 A * 12/1987 Stemler ..... E01D 19/125 404/54
5,025,522 A 6/1991 Eskew
5,218,795 A 6/1993 Horstketter
8,234,827 B1 * 8/2012 Schroeder, Sr. ..... E04B 1/24 52/638
9,279,244 B1 3/2016 Miller
10,280,635 B1 * 5/2019 Apostolopoulos ..... F03D 80/50
2012/0291378 A1 * 11/2012 Schroeder, Sr. ..... E04B 5/40 29/897.3
2018/0298601 A1 * 10/2018 Brodowski ..... E04B 5/40
2020/0392719 A1 * 12/2020 Brodowski ..... E04B 1/2403

FOREIGN PATENT DOCUMENTS

CN 112411385 2/2021
DE 102021108117 A1 * 10/2022 ..... E04B 1/40
GB 2585534 1/2021

* cited by examiner

*Primary Examiner* — Raymond W Addie
(74) *Attorney, Agent, or Firm* — Defillo & Associates, Inc; Evelyn A. Defillo

(57) ABSTRACT

Bridge construction method for a bridge formed by a series of beams placed between slabs, supported by angular profiles affixed to the beams. The method includes the steps of: fixing clips to edges of the upper surface of the beams, placing the beams on their supports, calculating the correct position of the angular profiles according to the shape or position of the beams; joining fasteners on the angular profiles, at an individual height determined according to the calculated positions; affixing the fasteners to the clips, so the angular profiles hang at the edges of the beams placing the slab on the angular profiles and casting concrete on the structure. The slabs are supported by angular profiles joined to the upper surface of the beams through a series of threaded protrusion carrying clips in said upper surface. Fasteners are joined to the clips and affixed to the angular profiles.

11 Claims, 5 Drawing Sheets

BRIDGE CONSTRUCTION METHOD AND BRIDGE

FIELD OF THE INVENTION

A construction methodology specially designed for the construction of bridges is proposed. It is based on clips placed along the deck-support beams for the placement of a lost form, slab, made by steel, commonly named precast metal deck (PMD) or steel in place (SIP). The bridge thus formed is also an object of the invention.

BACKGROUND OF THE INVENTION

A bridge construction method is known in the state of the art in which several !-beams are placed in parallel, two longitudinal angular profiles are welded to clips embedded in the longitudinal edges of concrete beams. This process is done manually with the workers on top of the beams.

One of the problems is the location of the angular profiles should be done precisely according to the final camber of the beams, each profile on the bridge has its own elevation. In actual practice, once the beams have been positioned, some workers must go through the beams lengthwise, surveying the real elevation of the beams and then manually weld the angular profiles in the exact position. This involves a large amount of labor and time and, above all, a high risk of accident due to working at heights and on narrow structures. It is necessary to reduce this risk of accident, improve the construction time and the accuracy in the positioning of the slabs. The need of correctly welding the angular profiles to several clips, means that the workers need to stay for a long time close to the edge of the beam, crouched, so the chance of an accidents is relatively high. This process can be found in U.S. Pat. No. 9,279,244.

U.S. Pat. No. 5,218,795, where the form is supported on the beam by adjustable screws is cited as a close prior art. Another method is shown in U.S. Pat. No. 5,025,522, where a bar is placed on the upper surface of the beam for the placement of the slab. The applicant is also aware of GB2585534 and CN112411385, which are of lesser relevance. The applicant is not aware of any solution equivalent to the one claimed.

SUMMARY OF THE INVENTION

Due to all this, a construction method and special designed clips are proposed that allow for the easy, fast, and safe construction of bridges.

The beams that form the bridges in which the invention is applied are usually of the "I" type. However, it has to be considered that the method is applicable on any beam with a substantially horizontal upper part. In the figures I-beams have been shown, but the beams of the invention may be of square section, T-beams, C-beams . . . . The beams will usually be made of concrete, but steel beams are also applicable to the method.

The bridge construction method allows for the construction of a bridge formed by a series of beams, between which forms are placed. The forms are lost forms and are supported by angular profiles affixed to the beams.

The construction steps are as follows:

Optionally, first a set of clips are fixed to the edges of the upper surface of the beams. They can be welded to a metal beam or inserted in a concrete beam at the precast factory. The clips may create a series of threaded studs on the upper surface of the beam.

The correct position of the angular profiles is calculated according to the shape or position of the beams. This shape or position may be measured before the placement of the beams or after.

The effective height of each angular profile is determined according to the calculated positions. That is, each individual angular profile may be joined to the beam at a different height, or angle, regarding the top or lower surface of the beam.

Then, angular profiles are affixed to the clips, so that the angular profiles hang at the edges of the beams. If the clips are in place, the angular profiles are affixed to the clips. If not, a bolt gun can be used to directly attach the angular profile to the beam. Other fixing methods are possible. The angular profiles can be placed at the beam before or after it is raised to its final position.

Once the beam and the adjoining beam are placed on their supports (columns . . . ) to form the bearing structure of the bridge, the form is placed on the angular profiles, and concrete is cast on the structure thus formed.

The angular profile may be a "Z" profile. In that case, the height of the angular profile corresponds to the height of the middle part of the "Z" profile. Therefore, the "Z" profiles are made once their height is calculated, by plying a flat o "L" shaped profile.

The angular profile may be a "L" profile attached to a fastener, which in turn is affixed to the clip. In that case, the fasteners may be affixed to the clips with a set of nut and washer, or any fast method.

In a preferred embodiment, the individual height of each angular profile is calculated by surveying the beam at the precast factory.

In another preferred embodiment, the individual height of each angular profile is calculated once the beam is placed on its supports.

The invention is also the bridge formed with this method. This bridge is therefore formed by at least two beams, and a series of forms between any pair of adjacent beams. The forms are supported by angular profiles joined to the upper surface of the beams through a series of threaded protrusion carrying clips in said upper surface. On that upper surface a set of fasteners, affixed to the angular profiles, are joined.

Other variants and embodiments will be appreciated in the remainder of the specification.

BRIEF DESCRIPTION OF THE DRAWINGS

To complement the description below and in order to provide a better understanding of the invention, a set of drawings is attached as an integral part of said description according to a preferred example of its practical embodiment. In those drawings, with an illustrative and non-limiting nature, the following has been represented.

DETAILED DESCRIPTION OF THE INVENTION

Figure 1:
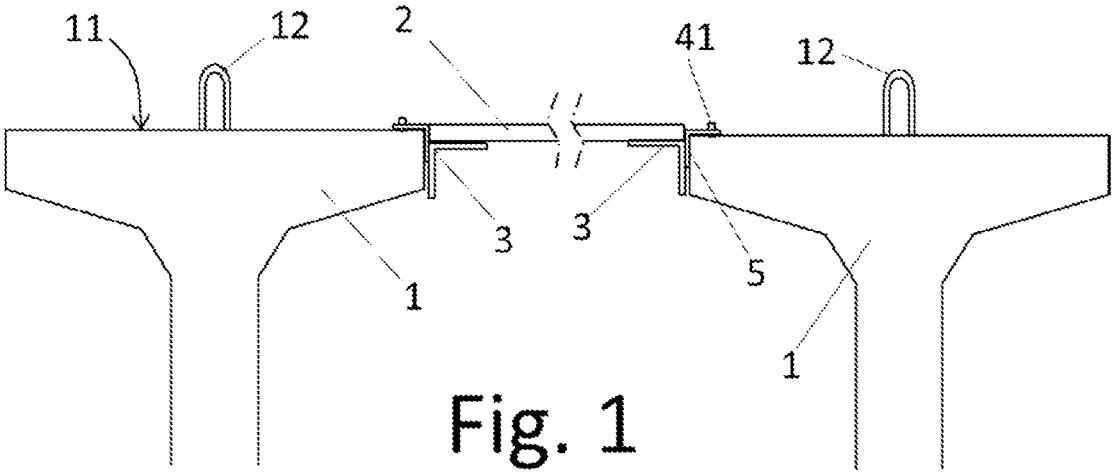
FIG. 1 shows a front view of an example of a bridge with the forms and the angular profiles, a "L" profile in this case.

FIG. 1 shows a schematic of a bridge where the invention is applied. It can be seen that the bridge has a series of beams (1), with a substantially horizontal upper surface (11) from which some reinforcement bars (12) usually protrude. Between two adjacent beams (1) there is a form (2) supported by both beams (1). The form (2) is usually made of metal, as in precast metal deck (PMD) or steel in place (SIP) manufacturing methods, but other materials can be used. For instance, concrete can be also used. The support of the form (2) on each beam (1) is carried out by separate longitudinal angular profiles (3) of steel plate. These angular profiles (3) are welded to a set of fasteners (5) at the right height. Then the fasteners (5) are supported by the threated studs (41) welded to the clips (4) embedded in the concrete beam (1). In case of a steel beam, the clips (4) may only contain the threated studs (41), directly welded on top of the steel beam (1).

Figure 2:
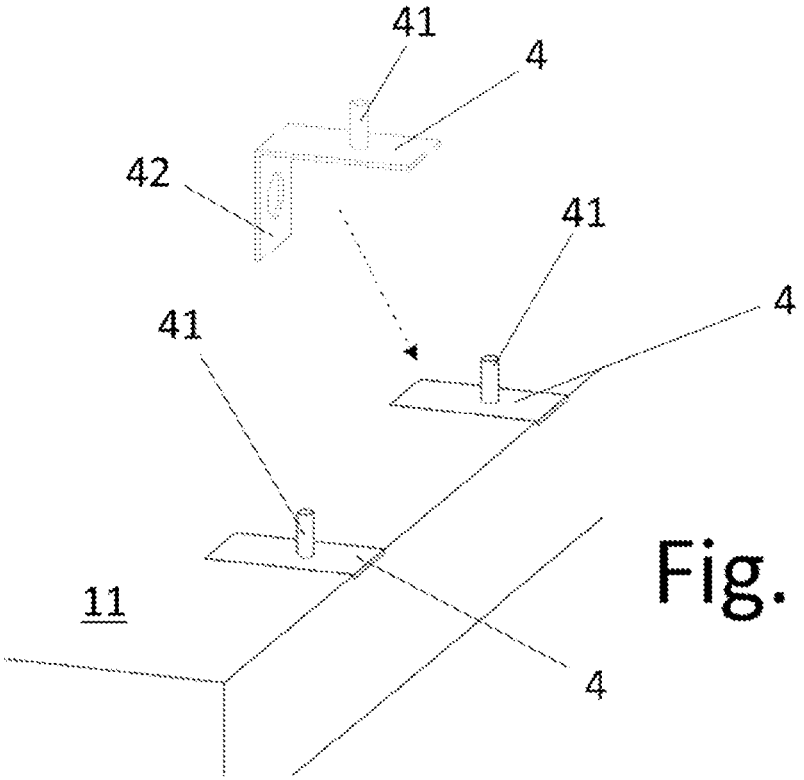
FIG. 2 shows a perspective schematic view of an embodiment of the upper surface of the beam with clips, and a view of the complete clip.

FIG. 2 shows another perspective of the beam (1). It comprises a set of clips (4) embedded or fixed to its upper surface (11), close to the edge. The clips (4) have a threaded protrusion (41) perpendicular to the upper surface (11). Those threaded studs (41) are set at a predetermined distance, e.g., one each 1-4 feet. The clips (4) can be placed when casting the concrete beam or welded to the metal beam in the factory. Therefore, the beam (1) carries the clips (4) before its placement in the manufacturing phase. In FIG. 2 an exemplary embodiment of the clip (4) is shown. The clip has an insertable part (42) so the concrete can better take hold the clip (4). The insertable part (42) may have a hole for a rebar or for the concrete to grip the clip (4).

Figure 3:
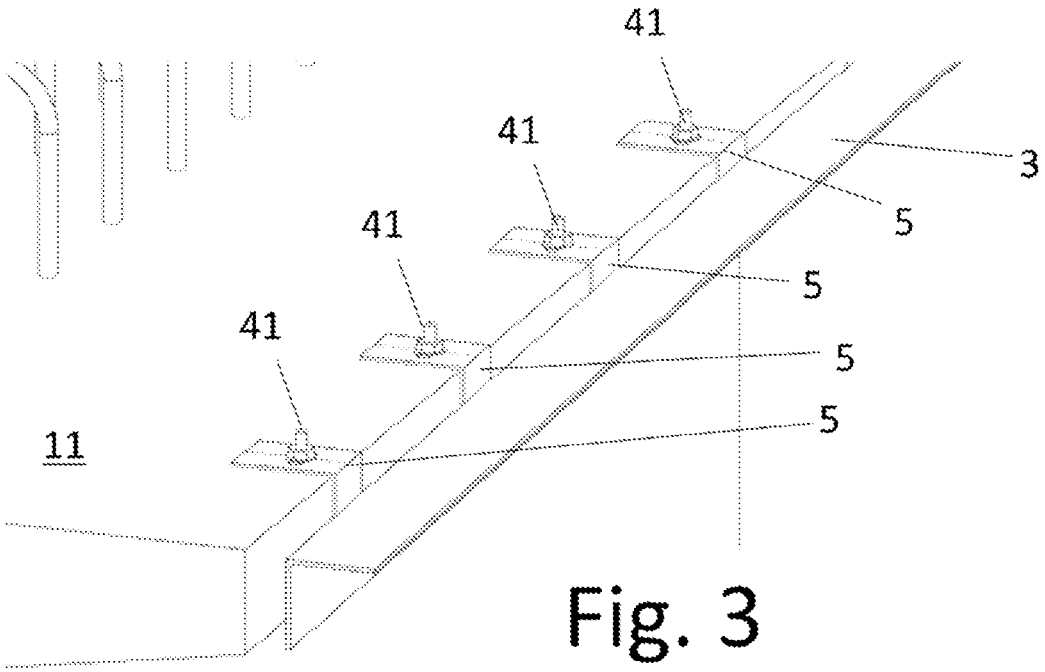
FIG. 3 shows a perspective schematic view of the embodiment of FIG. 2 with the angular profiles and fasteners when the angular profile is welded to the fastener.
Figure 4:
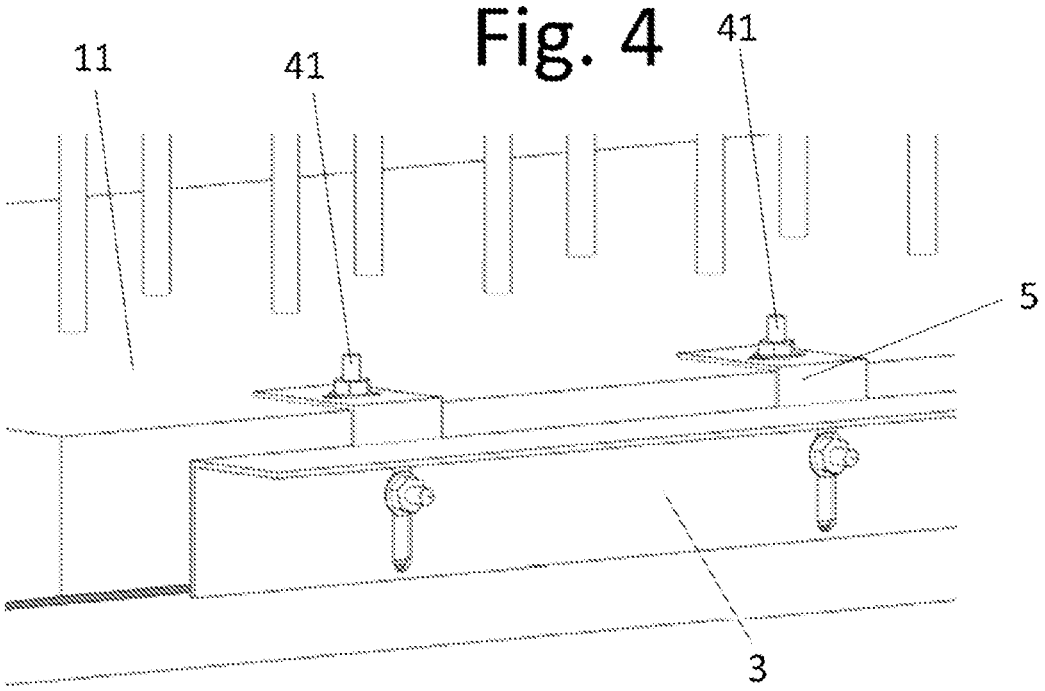
FIG. 4 shows a perspective schematic view of another embodiment of the beam with the angular profiles and fasteners when the angular is bolted to the fastener.

The angular profiles (3) are disposed at the side of the beam (1), as shown in FIGS. 1, 3 and 4. They are fixed to the clips (4) through several fasteners (5). FIGS. 3 and 4 show two different examples of fasteners (5). The fasteners (5) may have a slotted hole for each threaded protrusion (41) so it adapts to small placing errors. The fasteners (5) are held in place by nuts, washers or the like, threaded in the threaded protrusions studs (41). FIG. 3 show the fasteners (5) welded to the profiles (3) at the right elevation or height. FIG. 4 shows the fasteners (5) attached to the angular profiles (3) through a second threaded stud with nuts and washers, in this case the right elevation is achieved through a slotted profile in the vertical part of the angular profile (3).

In order to ensure the correct placement of the form (2), each fastener (5) is joined to the angular profiles (3) at different heights (see FIG. 3). Therefore, even if the beam (1) is not at its exact position or is cambered, the form (2) rests on angular profiles (3) at the right elevation.

As specially seen in FIG. 3, the height of the angular profile (3) at each point is different, so each fastener (5) is welded at a different point. Therefore, the angular profile (3) is shown with an angle, i.e., not parallel to the upper surface (11) of the beam (1). This effect is embellished in the figure to better show the intermediate result of the method.

Figure 5:
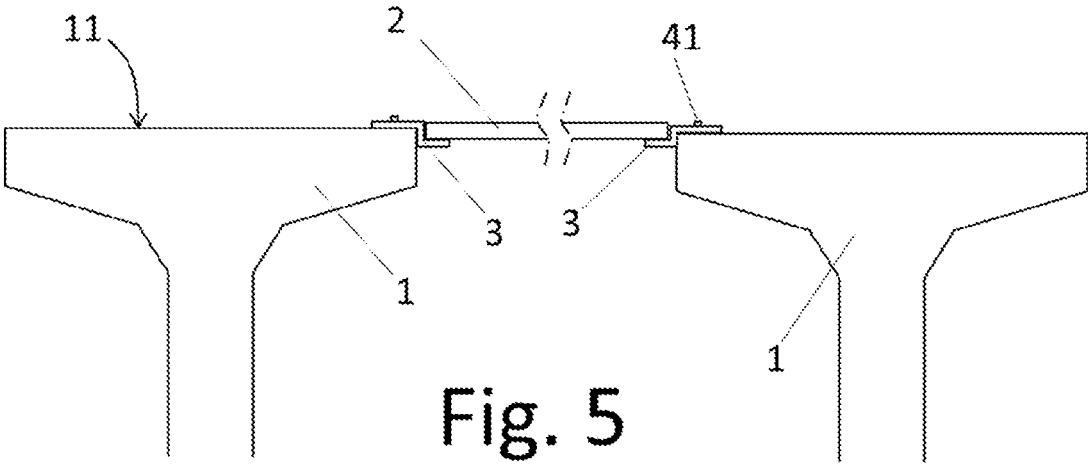
FIG. 5 shows a front view of a second example of a bridge with the forms and the angular profiles shaped like a "Z"

FIG. 5 shows a schematic of another bridge where the invention is applied. Most of the elements are the same as in FIG. 1. However, in this case, the angular profiles (3) are "Z" profiles, as in FIG. 6. "Z" profiles don't require a fastener, the profile is held by the clips (4) on its own. The support of the form (2) on each beam (1) is carried out by separate longitudinal "Z" profiles of steel plate. This "Z" profiles are supported by the threated studs (41) welded to the clips (4) embedded in the concrete beam (1). In this embodiment, the vertical part of the "Z" profile is variable in order to adjust the elevation of the form (2).

Figure 6:
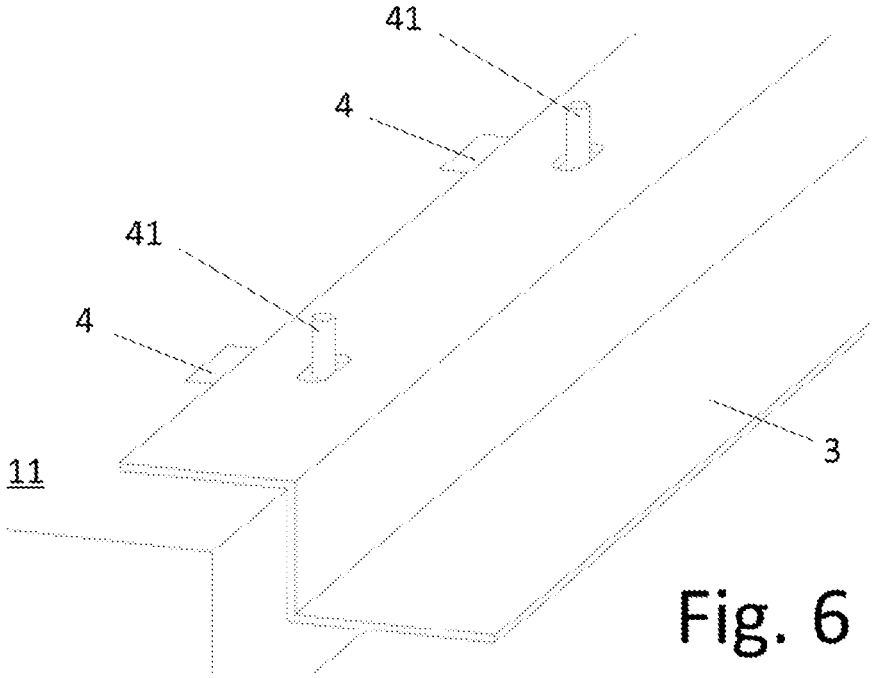
FIG. 6 shows a perspective schematic view of another embodiment of the beam with the angular profiles.

FIG. 6 shows another perspective of the beam (1). It comprises a set of clips (4) embedded or fixed to its upper surface (11), close to the edge. The clips (4) have a threaded protrusion (41) perpendicular to the upper surface (11). Those threaded studs (41) are set at a predetermined distance, e.g., one each 1-4 feet. The clips (4) can be placed when casting the concrete beam or welded to the metal beam in the factory. Therefore, the beam (1) carries the clips (4) before its placement in the manufacturing phase.

The "Z" profiles are disposed at the side of the beam (1), as shown in FIGS. 5 and 6. They are fixed to the clips (4) through the top part of the "Z" profiles. The top part of the "Z" profiles may have a slotted hole for each threaded protrusion (41) so it adapts to small placing errors. The "Z" profiles are held in place by nuts, washers, or the like, threaded in the threaded studs (41).

The adjustment can be calculated by surveying the beam at the precast factory, so any error is measured and can be corrected. It can also be measured on site. In this case, once the beam (1) is placed on the columns, the position of the beam (1) is determined. A GPS, a system of radio beacons, a survey prism on the robot in combination with a total station for providing coordinates or any other high-precision system, as a 3D survey scanner to have the real elevation of the beam (1) can be used. This elevation is compared to the theoretical position of the beam (1) or the form (2). For example, using a BIM (Building Information Modeling) database can be used to find out the theoretical position of the beam (1) or the from (2) in the bridge manufacturing plans, or any other model may be used to calculate the theoretical position.

This knowledge allows to determine the distance between the edge of the beam (1) and the theoretical position of the form (2). Therefore, the distance between the edge of the beam (1) and the angular profile (3) can be defined at each point of the beam (1). Once those distances are calculated, the fasteners (5) can be joined to the angular profiles (3) at the right position or height. This way, the forms (2) are placed at exactly the right position, and so are the angular profiles (3) at each side (see FIG. 1).

The third alternative (FIG. 5) the distance between the edge of the beam (1) and the support of the "Z" profile can be defined at each point of the beam (1). Once those distances are calculated, the "Z" profile are bended to the right elevation or height. This way, the forms (2) are placed at exactly the right position, and the "Z" profiles at each side (see FIG. 1).

As shown in the figures, the fastener (5) can be joined to the "L" profiles in several ways. They can be welded together, joined by a nut and bolt, adhered to each other . . . . The only two requisites are the exactitude of the placement and the mechanical resistance. In FIG. 4C, the fastener (5) carries a bolt that passes through a slot in the "L" profile so as to allow for the variation of position. When the nut is tightened, the height is defined.

The fasteners (5) are joined to the "L" profiles on the ground, so the workers can do their tasks safely. Once joined, they can be placed on the clips (4) and fixed with a nut and bolt. This manipulation on site is fast and can be done with powered tools, so the time spent on top of the beam (1) is greatly reduced. In a similar way, the "Z"

profiles will be made on the ground, so the operations on top of the beam (1) are also reduced. The need to be on top of the beam can be eliminated if the angular profiles (3) are attached to the beams (1) even before erecting the beams (1). In this manner we reduce the risk of the worker to the minimum.

Figure 7:
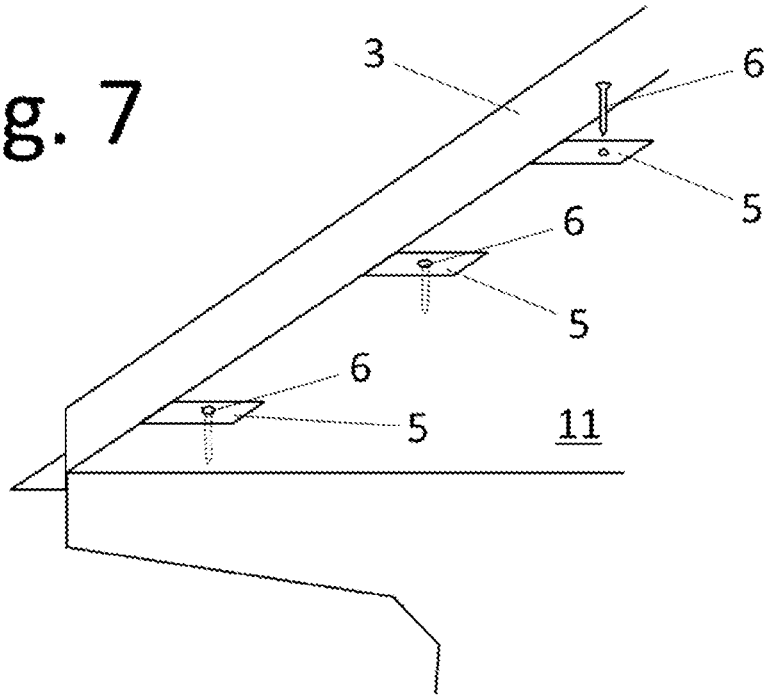
FIG. 7 shows a perspective schematic view of a third embodiment of the upper surface of the beam without clips.

In FIG. 7, still another embodiment is shown. In this case, the angular profile (3) is attached to the beam through a bolt (6). This way, the clip (4) is not necessary. The bolt (6) can be inserted in the concrete beam (1) with the aid of a concrete bolt gun. The angular profile (3) will be already pierced to reduce the resistance to the bolt (6).

The invention claimed is:

1. A bridge construction method, for a bridge formed by a series of beams, between which forms are placed, the forms are supported by angular profiles affixed to the beams, the method comprising the steps of:

calculating a correct elevation of each one of the angular profiles according to a shape or a position of the beams;

manufacturing the angular profiles with an individual height or an angle determined according to the calculated elevation;

affixing the angular profiles to the beam, so that the angular profiles hang at the edges of the beams, wherein each one of the angular profiles are fixed to the beam at a different individual height with regards to an upper surface of the beam;

placing the form on the angular profiles to form a structure;

casting a concrete on the structure;

wherein the beams are placed on supports at any point before the form placing.

2. The bridge construction method according to claim 1, wherein clips are fixed to the beams before the placement on the supports and the angular profiles are joined to the clips.

3. The bridge construction method according to claim 2, wherein the height of the angular profiles is defined by a position of a fastener affixed to the clips.

4. The bridge construction method according to claim 3, wherein the fasteners are affixed to the clips by a threaded nut.

5. The bridge construction method according to claim 2, wherein the beams are concrete beams and the clips are placed when casting the concrete.

6. The bridge construction method according to claim 2, wherein the beams are steel beams and the clips are welded.

7. The bridge construction method according to claim 1, wherein the individual height of each angular profile is calculated by surveying the beam at a precast factory.

8. The bridge construction method according to claim 1, wherein the individual height of each angular profile is calculated once the beam is placed on the supports.

9. The bridge construction method according to claim 1, wherein the angular profiles are affixed to the beams by a bolt fired by a bolt gun.

10. The bridge construction method according to claim 1, wherein the angular profiles are "Z" profiles and the individual height of the angular profiles is defined by a length of a middle portion.

11. A bridge formed by the method of claim 1, and comprising: at least two beams and a series of forms between adjacent beams, wherein the forms are supported by angular profiles joined to an upper surface of the beams, wherein each one of the angular profiles can be fixed to the beam at a different individual height with regards to a top surface of the beam; thus, the angular profiles are different at each point.

* * * * *